US009653276B2

(12) United States Patent
Covey et al.

(10) Patent No.: US 9,653,276 B2
(45) Date of Patent: May 16, 2017

(54) ENHANCED SPRAY FORMATION FOR LIQUID SAMPLES

(71) Applicant: DH Technologies Development PTE Ltd., Singapore (SG)

(72) Inventors: Thomas Covey, Richmond Hill (CA); Peter Kovarik, Markham (CA)

(73) Assignee: DH Technologies Development Pte Ltd., Singapore (SG)

( * ) Notice: Subject to any disclaimer, the term of this patent is extended or adjusted under 35 U.S.C. 154(b) by 0 days.

(21) Appl. No.: 14/910,032

(22) PCT Filed: Aug. 5, 2014

(86) PCT No.: PCT/IB2014/001463

§ 371 (c)(1),
(2) Date: Feb. 4, 2016

(87) PCT Pub. No.: WO2015/019157

PCT Pub. Date: Feb. 12, 2015

(65) Prior Publication Data

US 2016/0181082 A1 Jun. 23, 2016

Related U.S. Application Data

(60) Provisional application No. 61/863,307, filed on Aug. 7, 2013.

(51) Int. Cl.
*H01J 49/04* (2006.01)
*H01J 49/16* (2006.01)

(52) U.S. Cl.
CPC ..... *H01J 49/165* (2013.01); *H01J 49/045* (2013.01)

(58) Field of Classification Search
CPC .... H01J 49/04; H01J 49/0404; H01J 49/0431; H01J 49/0445; H01J 49/045; H01J 49/165; H01J 49/167
See application file for complete search history.

(56) References Cited

U.S. PATENT DOCUMENTS 5,306,412 A * 4/1994 Whitehouse ..... B05B 17/0623 204/452
2002/0158196 A1* 10/2002 Berggren ..... H01J 49/165 250/288
2009/0045330 A1 2/2009 Wang et al.
2011/0147576 A1* 6/2011 Wouters ..... H01J 49/167 250/282
2011/0204220 A1* 8/2011 Van Wuijckhuijse ... G01N 1/38 250/282
2012/0292501 A1* 11/2012 Sugiyama ..... H01J 49/105 250/288

(Continued)

OTHER PUBLICATIONS

International Search Report and Written Opinion for PCT/IB2014/001463 mailed Dec. 22, 2014.

*Primary Examiner* — David E Smith

(57) ABSTRACT

Methods and systems for generating ions from a liquid sample for mass spectrometry are provided herein. In various aspects, the methods and systems can enhance the break-up of a jet of the liquid sample upon injection into an ionization chamber. In some aspects, methods and systems perturb the liquid sample prior to discharge to increase the internal energy of the sample so as to enhance the formation of liquid droplets when the liquid sample is injected into the ionization chamber.

17 Claims, 7 Drawing Sheets

(56) References Cited

U.S. PATENT DOCUMENTS

| | | | | |
|---|---|---|---|---|
| 2012/0318973 | A1 | 12/2012 | Loucks et al. | |
| 2012/0325925 | A1* | 12/2012 | Ivaldi | B05B 17/0646 239/4 |
| 2013/0334030 | A1* | 12/2013 | Otsuka | H01J 49/165 204/164 |

* cited by examiner

ENHANCED SPRAY FORMATION FOR LIQUID SAMPLES

RELATED APPLICATION

This application claims priority to U.S. provisional application No. 61/863,307, filed Aug. 7, 2013, which is incorporated herein by reference in its entirety.

FIELD

The present teachings generally relate to mass spectrometry, and more particularly and without limitation, to methods and apparatus for generating ions from a liquid sample for mass spectrometric analysis in a downstream mass analyzer.

INTRODUCTION

Mass spectrometry (MS) is an analytical technique for determining the elemental composition of test substances with both qualitative and quantitative applications. MS can be useful for identifying unknown compounds, determining the isotopic composition of elements in a molecule, determining the structure of a particular compound by observing its fragmentation, and quantifying the amount of a particular compound in a sample. Because MS utilizes the transport, manipulation, and detection of ionic species, compounds of interest must first be converted to charged ions during the sampling process.

Over the years, various sampling techniques have been developed to convert chemical entities within a liquid sample into charged ions suitable for detection with MS. By way of example, a liquid sample containing one or more species of interest can be converted into a sample plume comprising charged species of interest by employing atomizers, nebulizers, and/or electrosprayers. One of the more common methods of ionizing a liquid sample is electrospray ionization (ESI), in which a liquid sample is discharged into an ionization chamber via a needle or nozzle. A strong electric field generated by an electric potential difference between the needle and a counter electrode electrically charges the liquid sample and causes the jet of liquid to explode into a plurality of micro-droplets if the charge imposed on the liquid's surface is strong enough to overcome the surface tension of the liquid (i.e., the particles attempt to disperse the charge and return to a lower energy state), thus forming a plurality of finely charged droplets containing analyte molecules. As solvent within the micro-droplets evaporates during desolvation in the ionization chamber, bare charged analyte ions can enter the sampling orifice of the mass analyzer.

Pure ESI, however, may be limited by the inefficient breakup of a liquid jet at high sample flow rates and/or the inefficient breakup of high surface tension liquids. As a result, various techniques such as pneumatic assisted electrospray, dual electrospray, and nano-electrospray have been developed to assist in the formation of micro-droplets upon the liquid sample exiting the needle. For example, in nano-electrospray, the needle has a smaller exit aperture relative to that of conventional ESI such that finer micro-droplets can be generated, even from liquid samples exhibiting high surface tensions. The relatively low flow rate of nano-electrospray, however, can result in decreased sensitivity and/or poor sample utilization. Moreover, nano-electrospray can limit the application of upstream separation techniques that offer complementary selectivity to MS (e.g., liquid chromatography-based sample preparation).

Alternatively, in pneumatic assisted electrospray, a nebulizer gas is flowed past the exit aperture of the needle while discharging the liquid sample into the ionization chamber such that shearing forces at the boundary between the fast moving gas and slower moving liquid aid in the formation of micro-droplets. Though nebulization gas can aid in the formation of a sample plume at higher liquid flow rates and/or with higher surface tension liquids, the nebulizing gas flow also decreases residency time in the ionization chamber and spatially dilutes the micro-droplets into a relatively large volume, thereby ultimately reducing the number and/or fraction of ionized sample ions in front of the sampling orifice.

Accordingly, there remains a need for enhanced systems, methods and devices for ionizing a sample for mass spectrometric analysis.

SUMMARY

Methods and systems for generating ions for analysis by mass spectrometry are provided herein. In accordance with various aspects of the applicants' teachings, the methods and systems can be effective to enhance the break-up of a jet of a liquid sample injected into an ionization chamber. Alternatively or in addition to heating the liquid sample or providing a nebulizing flow at the ion source tip as is known in the art, the present teachings provide for the deposition of internal energy into the liquid sample in the form of perturbations (e.g., shock waves, cavitation bubbles, injected gas bubbles) prior to injection into the ionization chamber. As a result, the jet of liquid sample can be more readily broken up into a sample plume comprising a plurality of micro-droplets. Accordingly, in some embodiments, ionization efficiency and sensitivity of the analysis can be improved, higher sample flow rates can be more effectively utilized, and analyses can be performed on higher surface tension liquids.

In accordance with various aspects, certain embodiments of the applicants' teachings relate to an apparatus for generating ions for analysis by a mass spectrometer that includes an ion source housing that defines an ion source chamber that is configured to be in fluid communication with a sampling orifice of a mass spectrometer, a conduit having an inlet end for receiving a liquid sample and an outlet end for discharging the liquid sample into the ion source chamber such that the discharged liquid forms a sample plume comprising a plurality of liquid droplets, and means for perturbing the liquid sample flowing within the conduit so as to enhance the formation of liquid droplets when the liquid sample is discharged from the outlet end into the ion source chamber. The apparatus can also include means for ionizing one or more analytes contained within the liquid droplets.

Conduits for receiving a liquid sample and discharging said sample into the ion source chamber can have a variety of configurations. By way of example, in some aspects, the conduit can comprise a capillary tube. In accordance with various aspects of the present teachings, the capillary tube can extend through a conduit configured to supply a nebulizer gas at the outlet end of the capillary tube. By way of non-limiting example, the nebulizer gas can have a flow rate in a range from about 0.1 L/min. to about 20 L/min. In various aspects, the nebulizer gas can have a flow rate such that a mass ratio of the nebulizer gas to the liquid sample being nebulized is less than about 60 over a liquid flow range of about 10 μL/min to about 10 mL/min (e.g., less than about 50 over a liquid flow range of about 10 μL/min to about 10 mL/min). In some aspects, the mass ratio can be less than about 30. In various aspects, the outlet end of the conduit can comprise a nozzle.

Various mechanisms can be utilized for perturbing the liquid sample flowing within the conduit. In some aspects, perturbing the liquid sample can comprise increasing the internal energy of the liquid sample and/or generating cavitation bubbles within the liquid sample. In various aspects, the means for perturbing the liquid sample can comprise means for generating pressure waves within the liquid sample, which can, for example, generate cavitation bubbles within the liquid sample. In related aspects, an oscillating diaphragm in fluid communication with the liquid sample can generate pressure waves therein. For example, the diaphragm oscillates at a frequency less than about 20 kHz. In some aspects, the frequency is less than about 1000 Hz. In some aspects, an ultrasonic transducer can be used to perturb the liquid sample.

Alternatively or additionally, the means for perturbing the liquid sample can comprise flow restrictions in said conduit. For example, the flow restrictions can comprise baffles within the conduit.

In some aspects, the means for perturbing the liquid sample is configured to inject gas within the liquid sample. Further, the apparatus can include means for mixing the liquid sample following gas injection to distribute gas bubbles within the liquid sample. The means for mixing can, in some aspect, allow a more uniform distribution of the bubbles in the sample liquid.

In various aspects, the means for perturbing the liquid sample can be configured to increase a liquid/gas phase heterogeneity of the liquid sample within the conduit, wherein the liquid sample comprises a substantially homogenous liquid phase at the inlet end of the conduit. In some aspects, the apparatus can further comprise a heater for heating the liquid sample flowing in the conduit.

In accordance with various aspects, certain embodiments of the applicants' teachings relate to an apparatus for generating ions for analysis by a mass spectrometer that includes an ion source housing defining an ion source chamber, the ion source chamber configured to be in fluid communication with a sampling orifice of a mass spectrometer; a conduit having an inlet end for receiving a liquid sample and an outlet end for discharging the liquid sample into the ion source chamber such that the discharged liquid forms a sample plume, the sample plume comprising a plurality of liquid droplets; a gas injection port configured to generate bubbles in the liquid sample flowing within the conduit and prior to discharge from the outlet end of the conduit; and means for ionizing one or more analytes contained within the liquid droplets.

In accordance with various aspects, certain embodiments of the applicants' teachings relate to a method of generating ions for analysis by a mass spectrometer that comprises receiving a liquid sample at an inlet end of a conduit from a sample source; transporting the liquid sample from the inlet end of the conduit to an outlet end of the conduit; mechanically perturbing the liquid sample while being transported within the conduit; discharging the liquid sample from an outlet end of the conduit to an ion source chamber such that the discharged liquid forms a sample plume comprising a plurality of liquid droplets; and ionizing an analyte contained within the liquid droplets prior to entering a sampling orifice of a mass spectrometer in fluid communication with the ion source chamber.

The liquid in the conduit can be perturbed in a variety of manners. In some aspects, for example, perturbing the liquid sample can comprise increasing the internal energy of the liquid sample. In some aspects, perturbing the liquid sample comprises generating pressure waves within the liquid sample in the conduit. In various aspects, cavitation bubbles can be generated within the liquid sample in the conduit. Alternatively or additionally, perturbing the liquid sample can comprise injecting gas into the liquid sample prior to discharging said liquid sample from the outlet end. In some aspects, mechanically perturbing the sample can comprise increasing a liquid/gas phase heterogeneity of the liquid sample within the conduit, wherein the liquid sample comprises a substantially homogenous liquid phase at the inlet end of the conduit.

In some aspects, the method can also include heating the liquid sample within the conduit.

These and other features of the applicants' teachings are set forth herein.

BRIEF DESCRIPTION OF THE DRAWINGS

The skilled person in the art will understand that the drawings, described below, are for illustration purposes only. The drawings are not intended to limit the scope of the applicants' teachings in any way.

DETAILED DESCRIPTION

It will be appreciated that for clarity, the following discussion will explicate various aspects of embodiments of the applicants' teachings, while omitting certain specific details wherever convenient or appropriate to do so. For example, discussion of like or analogous features in alternative embodiments may be somewhat abbreviated. Well-known ideas or concepts may also for brevity not be discussed in any great detail. The skilled person will recognize that some embodiments of the applicants' teachings may not require certain of the specifically described details in every implementation, which are set forth herein only to provide a thorough understanding of the embodiments. Similarly it will be apparent that the described embodiments may be susceptible to alteration or variation according to common general knowledge without departing from the scope of the disclosure. The following detailed description of embodiments is not to be regarded as limiting the scope of the applicants' teachings in any manner.

In accordance with various aspects of the applicants' teachings, the methods and systems described herein can be effective to enhance the break-up of a jet of a liquid sample injected into an ionization chamber. Alternatively or in addition to heating the liquid sample or providing a nebulizing flow at the ion source tip as is known in the art, some aspects of the present teachings provide for the deposition of internal energy into the liquid sample in the form of perturbations (e.g., shock waves, cavitation bubbles, injected gas bubbles) prior to the liquid's injection into the ionization chamber. Without being bound by any particular theory, it is believed that by depositing internal energy into the liquid sample prior to injection, the surface tension exhibited by the liquid in the jet exiting the tip can be more easily overcome so as to more readily generate a fine mist of charged micro-droplets. In such a manner, the ionization efficiency and ultimately the sensitivity of the mass spectrometric analysis can be improved, without the spatial dilution or increased degradation of the sample resulting from conventional techniques, which rely on high flow rates of nebulizing gas, and often, increased temperatures required to promote desolvation. Moreover, various aspects of the present teachings can improve the analysis of fluid inputs exhibiting elevated flow rates and/or surface tensions.

Figure 1:
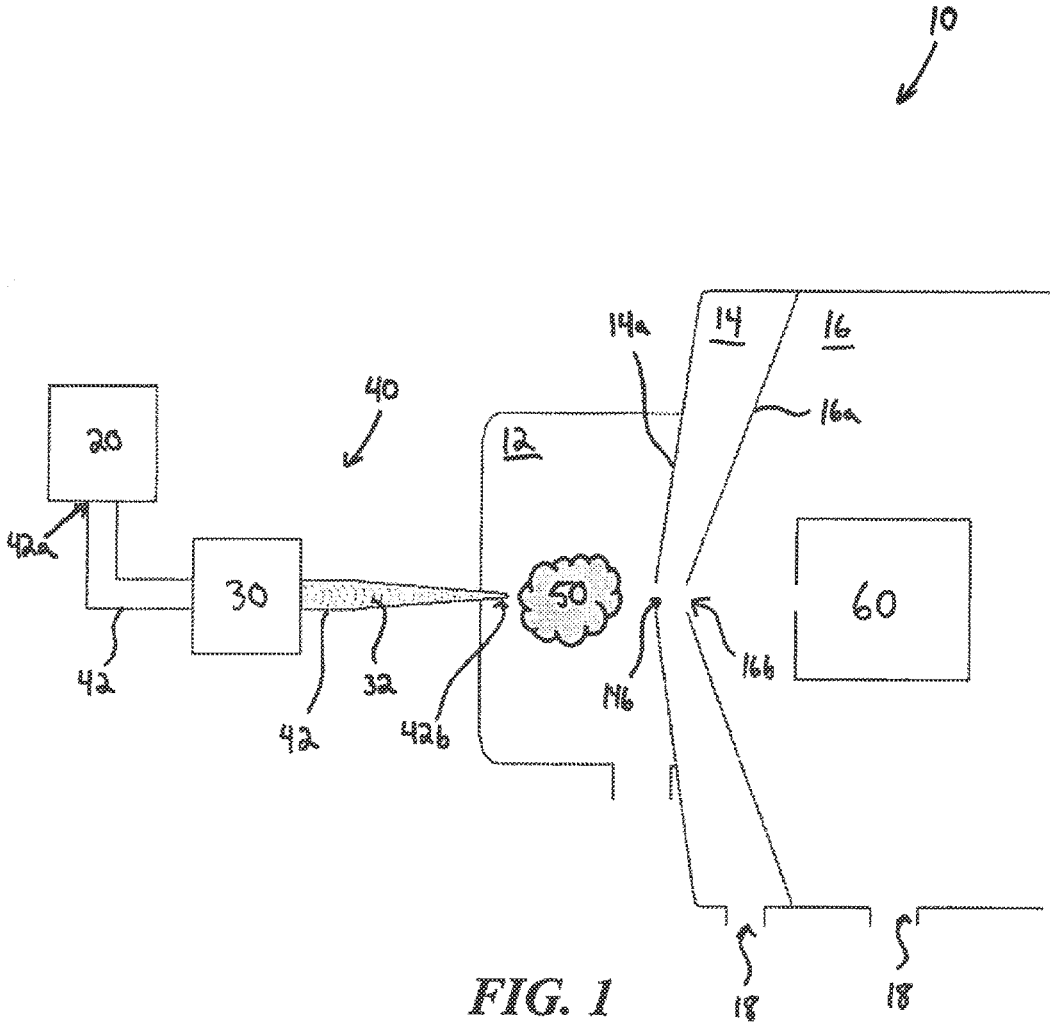
FIG. 1, in a schematic diagram, illustrates an exemplary mass spectrometry system for generating sample ions from a liquid sample in accordance with various aspects of the applicants' teachings.

FIG. 1 schematically depicts an exemplary embodiment of a mass spectrometer system 10 in accordance with various aspects of the applicants' teachings for generating sample ions from a liquid sample and delivering the sample ions to a sampling orifice of a mass spectrometer. As shown in FIG. 1, the mass spectrometer system 10 generally includes a liquid sample source 20, an ion source 40, and a mass analyzer 60 for downstream processing sample ions. The exemplary ion source 40 receives the liquid sample from the sample source 20 and discharges the liquid sample into an ionization chamber 12 defined by an ion source enclosure or housing. In the depicted embodiment, the ionization chamber 12 can be maintained at an atmospheric pressure, though in some embodiments, the ionization chamber 12 can be evacuated to a pressure lower than atmospheric pressure. The ionization chamber 12, within which analytes in the liquid sample are ionized, is separated from a gas curtain chamber 14 by a plate 14*a* having a curtain plate aperture 14*b*. As shown, a vacuum chamber 16, which houses the mass analyzer 60, is separated from the curtain chamber 14 by a plate 16*a* having a vacuum chamber sampling orifice 16*b*. The curtain chamber 14 and vacuum chamber can be maintained at a selected pressure(s) (e.g., the same or different sub-atmospheric pressures, a pressure lower than the ionization chamber) by evacuation through one or more vacuum pump ports 18. Further, as discussed in detail below, the system 10 additionally includes means 30 for perturbing the liquid sample so as to enhance the formation of liquid droplets when the liquid sample is discharged from the ion source 40.

As will be appreciated by a person skilled in the art, the ion source 40 can be fluidly coupled to and receive a liquid sample from a variety of liquid sample sources. By way of non-limiting example, the sample source 12 can comprise a reservoir of the sample to be analyzed or an input port through which the sample can be injected. Alternatively, also by way of non-limiting example, the liquid sample to be analyzed can be in the form of an eluent from a liquid chromatography column, for example.

The ion source 40 can have a variety of configurations but is generally configured to generate ions from the liquid sample that it receives from the sample source 20. In the exemplary embodiment depicted in FIG. 1, for example, the ion source 40 includes a conduit 42 (e.g., a capillary) that extends from an inlet end 42*a* in direct or indirect fluid communication with the sample source 20 to an outlet end 42*b* that at least partially extends into the ionization chamber 12. As the liquid sample is discharged from the outlet end 42*b* into the ionization chamber 12, the outlet end 42*b* discharges the liquid in the form of a sample plume 50 containing a plurality of micro-droplets of liquid sample generally directed toward (e.g., in the vicinity of) the curtain plate aperture 14*b* and vacuum chamber sampling orifice 16*b*. By way of example, the ion source 40 can atomize, aerosolize, nebulize, or otherwise discharge (e.g., spray with a nozzle) the liquid sample into the ionization chamber 12 through the outlet end 42*b* of the conduit 42 to form the sample plume 50. As is known in the art, analyte molecules contained within the micro-droplets can be ionized (i.e., charged) by the ion source 40, for example, as the sample plume 50 is generated. By way of non-limiting example, the outlet end 42*b* of the conduit can be made of a conductive material and electrically coupled to a pole of a voltage source (not shown), while the other pole of the voltage source can be grounded. Micro-droplets contained within the sample plume 50 can thus be charged by the voltage applied to outlet end 42*b* such that the liquid (e.g., solvent) within the droplets evaporate and the generated analyte ions are released and drawn toward and through the apertures 14*b*, 16*b* (e.g., 14*a*, 16*a* can be made electrically attractive to the ions/droplets). It will be appreciated that a number of different devices known in the art and modified in accord with the teachings herein can be utilized as the ion source 40. By way of non-limiting example, the ion source 40 can be a electrospray ionization device, a nebulizer assisted electrospray device, a chemical ionization device, a nebulizer assisted atomization device, a photoionization device, a laser ionization device, a thermospray ionization device, and a sonic spray ionization device. In some embodiments, the sample plume can be generated by a liquid stream impinging on a rapidly oscillating surface.

The mass analyzer 60 can have a variety of configurations but is generally configured to process (e.g., filter, sort, dissociate, detect, etc.) sample ions generated by the ion source 40. By way of non-limiting example, the mass analyzer 60 can be a triple quadrupole mass spectrometer, or any other mass analyzer known in the art and modified in accordance with the teachings herein. By way of example, ions generated by the ion source 40 can be drawn through orifices 14*b*, 16*b* and focused (e.g., via one or more ion lens) into the mass analyzer 60. The mass analyzer 60 can comprise a detector that can detect the ions which pass through the analyzer 60 and can, for example, supply a signal indicative of the number of ions per second which are detected.

As noted above, systems in accord with various aspects of the applicants' teachings are configured to increase the internal energy of the liquid sample flowing through the conduit 42 prior to being discharged in the ionization chamber. Without being bound by any particular theory, the release of at least a portion of the internal energy of the liquid upon the drop in pressure experienced by the liquid jet as it is discharged from the outlet end 42*b* (e.g., nozzle) can enhance the formation of the sample plume. In some embodiments, for example, the mass spectrometer system 10 comprises means 30 for perturbing the liquid sample flowing within the conduit 42 such that upon discharge from the ion source 40, the formation of liquid droplets (e.g., micro-droplets) is enhanced (e.g., increased number of droplets, decreased average droplet size, higher density of droplets in a decreased plume volume). As discussed otherwise herein, any number of physical perturbations 32 including pressure waves (e.g., ultrasound, shockwaves), cavitation bubbles, and gas bubbles (injected or otherwise generated) within the liquid of the conduit can be utilized to increase the internal energy of the liquid sample in accordance with the present teachings. In an exemplary embodiment, for example, the means 30 for perturbing the liquid sample can be a transducer coupled to the conduit 42 such that when activated, the transducer generates the perturbations 32 (e.g., pressure waves, sound waves, ultrasound) that are transmitted to the fluid flowing within the conduit.

In some aspects of the present teachings, the means 30 for perturbing the liquid sample can effect a change in the liquid/gas phase heterogeneity of the sample within the conduit 42. By way of example, the means 30 for perturbing the sample can be effective to increase the internal stress of the liquid sample during its passage through the conduit 42 so as to cause cavitation. As a result, local areas of phase change can occur within the sample. That is, a substantially homogenous liquid sample at the inlet end 42*a* of the conduit 42 can be subjected to sufficient stress such that the sample at the outlet end 42*b* contains a substantial gas-phase portion. These cavitation bubbles (e.g., vapor filled bubbles) within the liquid sample can similarly enhance the breakup of the liquid sample when discharged into the ion chamber 12, as otherwise discussed herein.

Figure 2A:
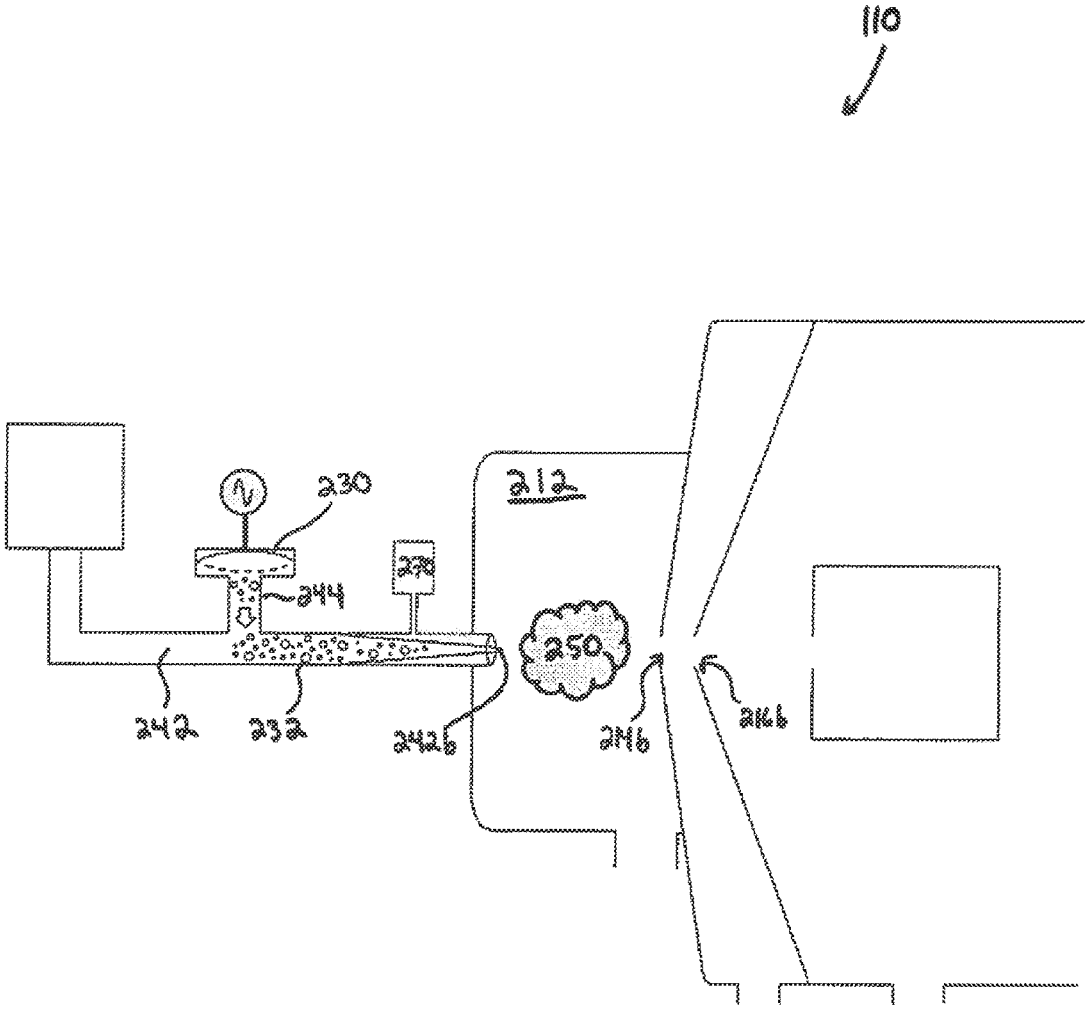
FIG. 2A, in a schematic diagram, illustrates another exemplary mass spectrometry system for generating sample ions from a liquid sample in accordance with various aspects of the applicants' teachings.
Figure 2B:
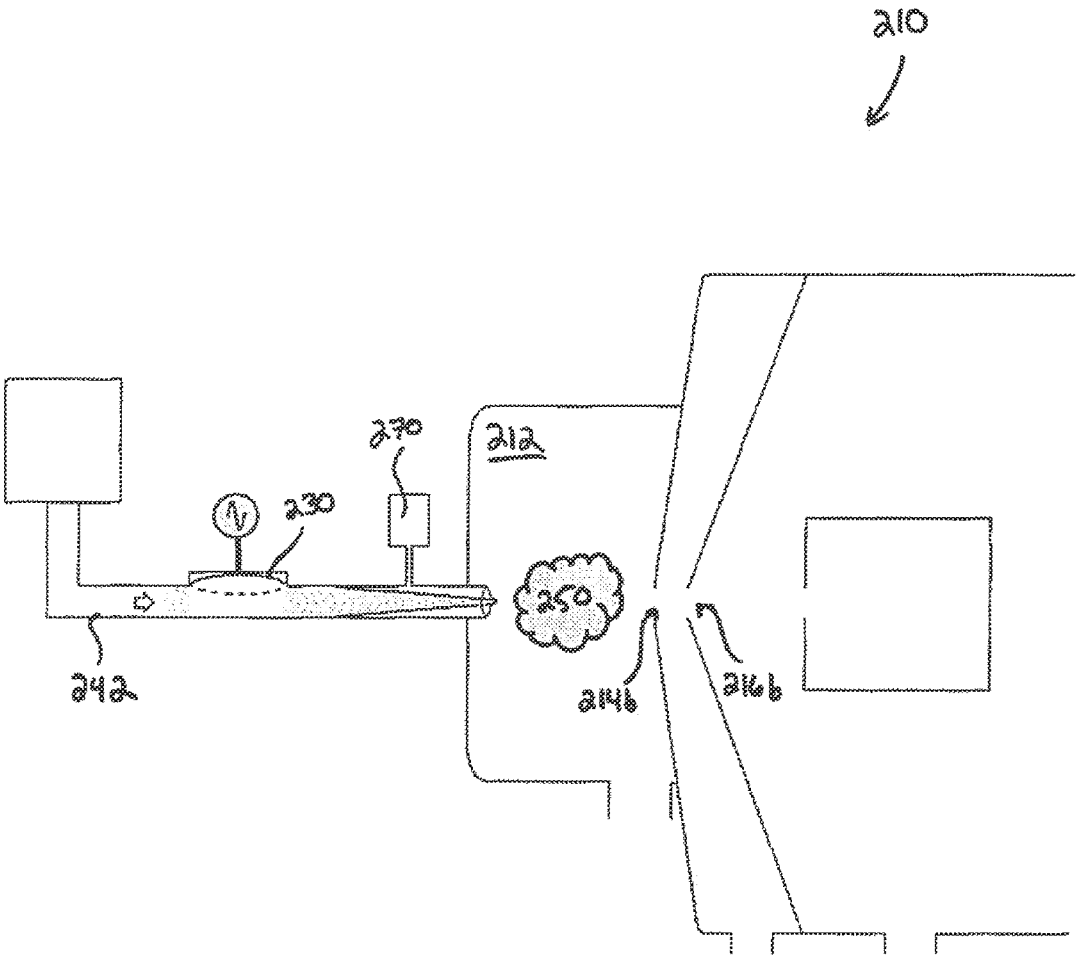
FIG. 2B, in a schematic diagram, illustrates another exemplary mass spectrometry system for generating sample ions from a liquid sample in accordance with various aspects of the applicants' teachings.
Figure 2C:
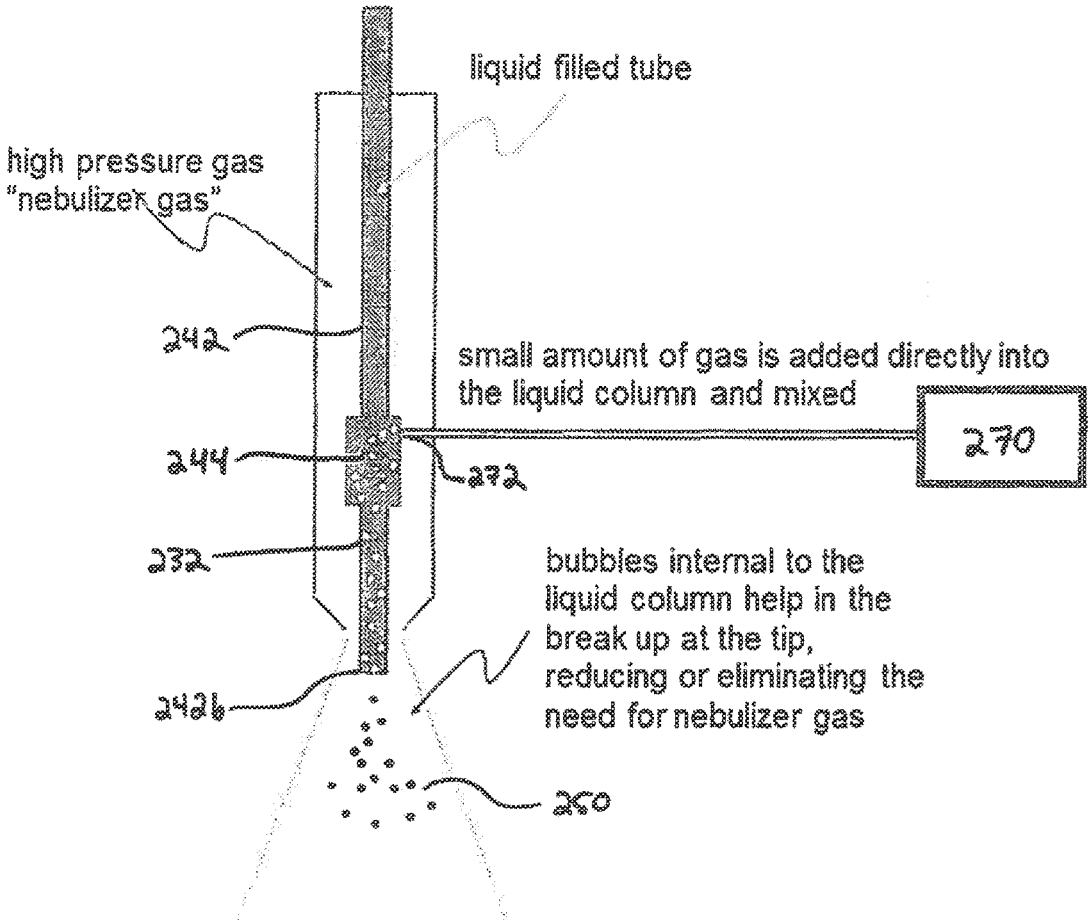
FIG. 2C, in a schematic diagram, illustrates another exemplary mass spectrometry system for generating sample ions from a liquid sample in accordance with various aspects of the applicants' teachings.

With reference now to FIG. 2A, another exemplary mass spectrometer system 110 in accordance with various aspects of the present teachings is schematically depicted. Mass spectrometer system 110 is an exemplary implementation of the system 10 of FIG. 1, but depicts liquid in the conduit 242 being perturbed through the action of an oscillating diaphragm 230. As shown in FIG. 2, the diaphragm 230 is disposed in fluid communication with the liquid sample within the conduit 242, e.g., through the fluid within the branch 244. Thus, as the diaphragm 230 oscillates, the action of the diaphragm 230 can be configured to generate cavitation bubbles 232 and/or pressure waves through the oscillations in the pressure during the diaphragm's cycles of tension and compression on the fluid. These perturbations can then be transmitted through liquid in the branch 244 and into the sample fluid within the conduit 242. A person skilled in the art will appreciate in light of the present teachings, that the diaphragm 232 can have a variety of configurations but generally is configured to generate sufficient internal stress such that the formation of the sample plume 250 is enhanced when the perturbed liquid is discharged through the outlet end 242*b* into the ionization chamber 212 as otherwise discussed herein. For example, the diaphragm 230 can be selected to operate at variety of frequencies (e.g., at a frequency less than about 20 kHz, less than about 1000 Hz) to optimize the internal stress resulting in the sample liquid, for example. Additionally, it will be appreciated in light of the present teachings that a diaphragm 230 can be fluidly coupled to the liquid in the conduit 242 in a variety of manners. For example, though the diaphragm 230 is shown disposed in the branch 244 in FIG. 2A, the diaphragm 230 of FIG. 2B instead comprises an oscillating flexible membrane that forms a portion of the conduit sidewall, for example.

Rather than generating bubbles within the liquid sample through cavitation, for example as discussed above, gas bubbles can additionally or alternatively be directly injected into the sample liquid prior to its discharge into the ionization chamber. By way of example, with reference now to FIG. 2C, a gas source 270 is fluidly coupled to the conduit 242 and is configured to deliver a gas (e.g., nitrogen, air, or noble gas) directly into the sample liquid flowing through the conduit 242 (e.g., through a valve 272). In such a manner, gas-phase bubbles 232 can be generated in the substantially homogenous liquid phase, thereby increasing the liquid/gas heterogeneity of the fluid in the conduit 242. By way of example, the liquid exhibiting a substantially homogenous liquid phase (e.g., less than 5% $v_{gas}/v_{liquid}$) can have gas introduced such that the fluid at the outlet end of the conduit exhibits greater than about 30% $v_{gas}/v_{liquid}$ (e.g., greater than about 40% $v_{gas}/v_{liquid}$, greater than about 50% $v_{gas}/v_{liquid}$). Optionally, in this specific embodiment, and indeed in any described herein, the system can further comprise structures (e.g., baffles 244) and/or mechanisms to ensure that the gas bubbles are mixed and/or more evenly distributed within the liquid sample. As discussed in more detail below herein, in some aspects of the present teachings, the bubbles 232 contained within the liquid sample can aid in the formation of the sample plume 250 when the liquid is discharged from the outlet end 242*b* into the ionization chamber such that the flow rate of nebulizing gas, if used, can be reduced or eliminated.

For example, with reference again to FIGS. 2A and 2B, the mass spectrometer system 210 can additionally include a source 270 of pressurized gas (e.g. nitrogen, air, or noble gas) that supplies a high velocity nebulizing gas flow which surrounds the outlet end 242*b* of the conduit 242 and interacts with the fluid ejected from the outlet end 242*b* to deliver the sample plume 250 towards the orifices 214*b*, 216*b* and/or enhance the formation of the sample plume 250, e.g., via the interaction of the high speed nebulizing flow and jet of liquid sample. The nebulizer gas can be supplied at a variety of flow rates, for example, in a range from about 0.1 L/min to about 20 L/min.

Applicants have discovered, however, that perturbations generated in the liquid sample can enhance the formation of the sample plume as discussed otherwise herein such that mass spectrometer systems in accordance with the present teachings can obtain acceptable or even improved signals, while reducing or eliminating the use of nebulizing gas. As a result, the present invention can likewise reduce or eliminate disadvantages associated with the use of the high speed nebulizing flow such as decreased residency time in the ionization chamber 212 and/or spatial dilution of the sample plume 250 and the concomitant reduction in sensitivity. By way of example, systems and methods in accordance with the present teachings can reduce the flow rate of nebulizer gas relative to conventional systems such that the mass ratio of the nebulizer gas to the liquid sample being nebulized is less than about 60 over a liquid flow rate of about 10 μL/min. to about 10 mL/min (e.g., less than about 50). In some aspects, for example, the methods and systems in accordance with the present teachings can be operated such that mass ratio is less than about 30. Moreover, as indicated above, the use of nebulizer gas may, in some embodiments, be eliminated altogether.

Figure 3:
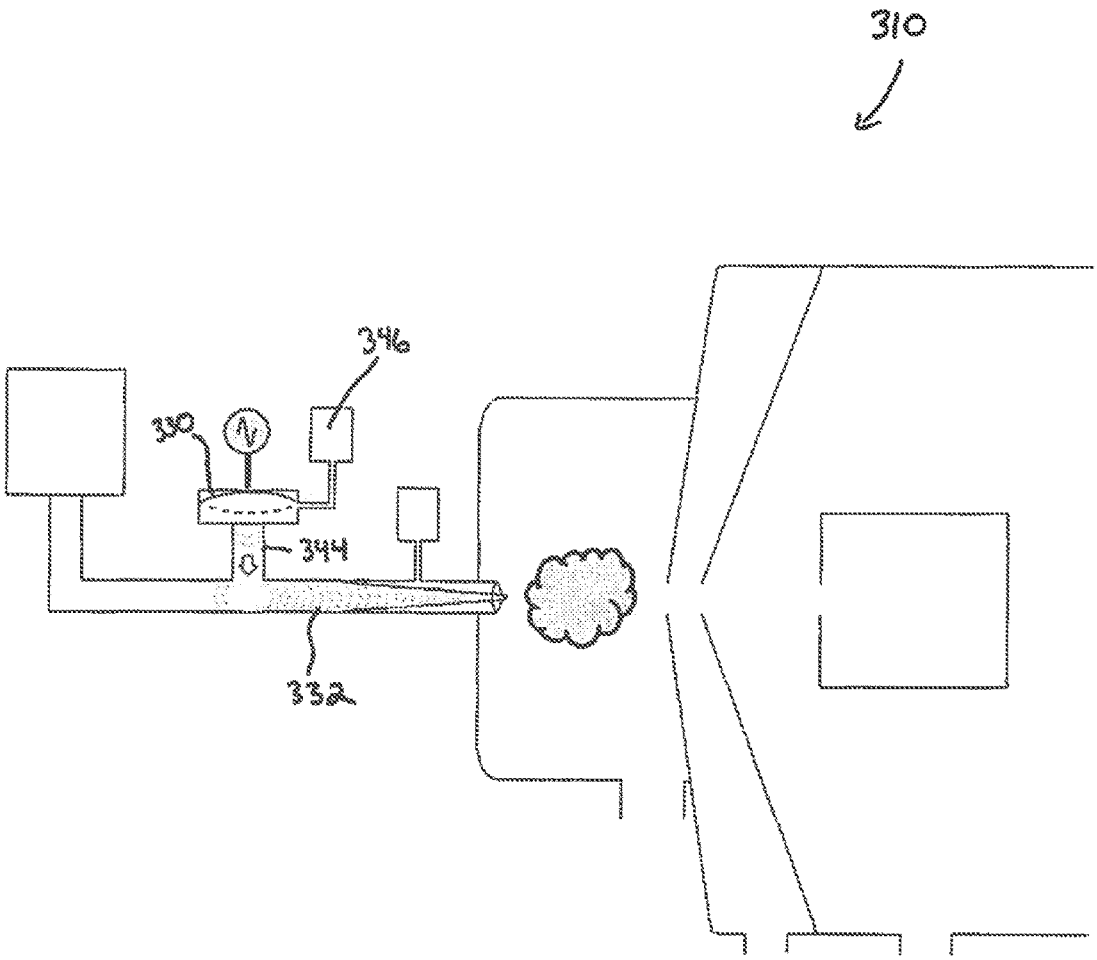
FIG. 3, in a schematic diagram, illustrates another exemplary mass spectrometry system for generating sample ions from a liquid sample in accordance with various aspects of the applicants' teachings.

With reference now to FIG. 3, another exemplary embodiment of a mass spectrometer system 310 is depicted. Mass spectrometer system 310 is substantially similar to that depicted in FIG. 2A but differs in that a liquid source 346 is provided for back filling a void (e.g., vacuum) generated during the retraction of the oscillating diaphragm 330. That is, the retraction of the diaphragm 330 (up in FIG. 3) at a high enough frequency could generate a vacuum sufficient to cause the pressure within the liquid to drop below its vapor pressure such that a cavitation bubble is generated. As will be appreciated by a person skilled in the art in light of the present teachings, the configuration depicted in FIG. 3 can therefore be configured to preferentially result in the formation of either pressure waves 332 or cavitation bubbles, depending on the flow of liquid from the liquid source 346.

Figure 4:
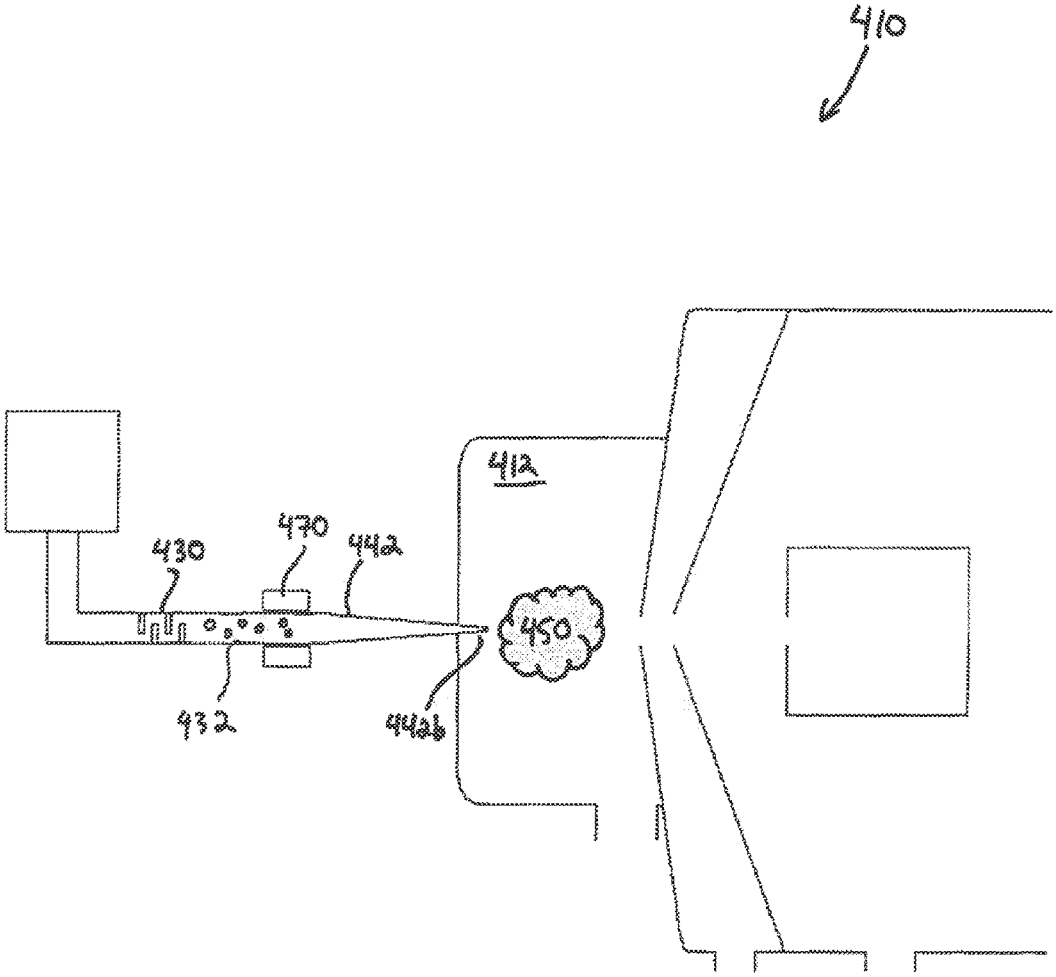
FIG. 4, in a schematic diagram, illustrates another exemplary mass spectrometry system for generating sample ions from a liquid sample in accordance with various aspects of the applicants' teachings.

With reference now to FIG. 4, another exemplary embodiment of a mass spectrometer system 410 for increasing the internal energy of a liquid sample within a conduit is depicted. The system 410 is substantially similar to those described above in that perturbations 432 are generated within the sample fluid flowing through the conduit prior to being discharged in the ionization chamber 412 (e.g., through a spray nozzle). However, the perturbations 432 in the liquid sample as shown in FIG. 4 are instead generated by flow restrictions within the conduit 242. By way of example, the flow restrictions (e.g., baffles 430) can be configured so as to promote the generation of cavitation bubbles 432 (or other perturbations in accordance with the present teachings) as the liquid sample stream interacts with the restrictions within the conduit 242.

Optionally, the mass spectrometer system 410 (and indeed any of the exemplary mass spectrometer systems described herein) can additionally include a heater 470 for heating the liquid sample as it nears the outlet end 442*b* of the conduit 442. As is recognized in the art, heating the liquid sample can promote desolvation as the sample plume traverses the ionization chamber 412.

Accordingly, the systems and methods described herein can be effective to increase the internal energy of the sample liquids within the conduit through, for example, mechanical perturbation of the fluid. This increase in energy, beyond the thermal and kinetic energy generally associated with sample liquid flows, can therefore be released from the liquid sample upon discharge into the ionization chamber such that the formation of the sample plume is enhanced. The resulting finer mist of charged micro-droplets, for example, can more readily be dissolved such that a larger number of analyte ions can be delivered to the sample orifice.

EXAMPLES

Figure 5:
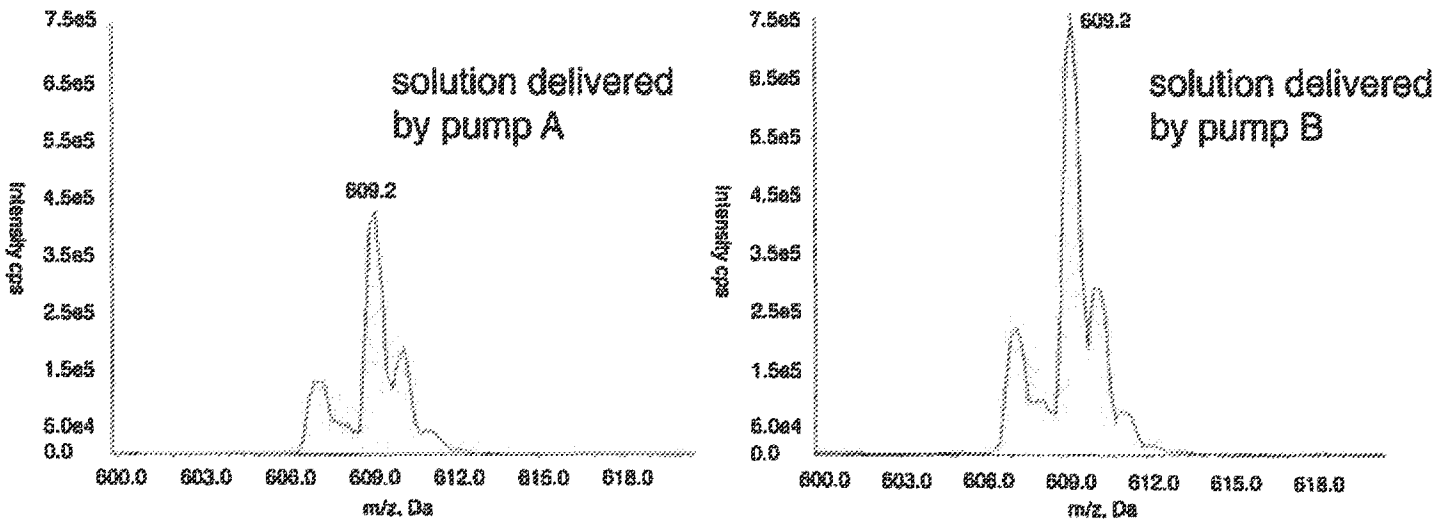
FIG. 5 depicts ion chromatograms comparing the intensity of ions detected using a conventional system for generating ions (A) and a system operated in accordance with various aspects of the applicants' teachings.

With reference now to FIG. 5, the ion chromatograms A (left) and B (right) depict the effect on the number of ions detected when operating two different pumps at identical flow rates of 18 μL of a reserpine solution prepared in 50% water, 50% methanol and 0.1% formic acid. Both pumps used the same solution. The API 4000 mass spectrometer was operated in a Q1 window scan type and used Turbo V source optimized for best performance in each case. Pump A operated with cavitation bubble removal and pressure wave dampening. Its performance, in terms of the mass spectrometer signal effectively matched that of a slow moving plunger pump (Harvard syringe pump) running at the same flow rate. The slow moving plunger of that pump (e.g., ~1 mm/min for typically sized syringe) does not generate cavitation bubbles or pressure waves. Pump B, a diaphragm pump, was modified at the check valves to provide greater liquid communication between the diaphragm and the conduit and its outlet end (e.g., 42*b* in FIG. 1). This resulted in pressure waves and cavitation bubbles travelling through the conduit and enhancing the sample plume formation through the more effective liquid break up at the outlet end. Pump B runs at 50 Hz and generates cavitation bubbles as visually evident, under appropriate magnification, by submerging its outlet in a liquid. Source optimization with the Pump B allowed 50% nebulizer gas reduction (mass ratio of ~50 for nebulizer gas to liquid flow). The combined effect of the cavitation bubbles and pressure waves present in the conduit and its outlet produced a substantial (1.5-2×) increase in the intensity of ions detected.

The section headings used herein are for organizational purposes only and are not to be construed as limiting. While the applicants' teachings are described in conjunction with various embodiments, it is not intended that the applicants' teachings be limited to such embodiments. On the contrary, the applicants' teachings encompass various alternatives, modifications, and equivalents, as will be appreciated by those of skill in the art.

What is claimed is:

1. An apparatus for generating ions for analysis by a mass spectrometer, comprising:

an ion source housing defining an ion source chamber, the ion source chamber configured to be in fluid communication with a sampling orifice of a mass spectrometer;

a conduit having an inlet end for receiving a liquid sample and an outlet end for discharging the liquid sample into the ion source chamber such that the discharged liquid forms a sample plume, the sample plume comprising a plurality of liquid droplets;

means for mechanically perturbing the liquid sample flowing within the conduit so as to enhance the formation of liquid droplets when the liquid sample is discharged from the outlet end into the ion source chamber;

wherein the outlet end of the conduit extends through a second conduit configured to supply a nebulizer gas at the outlet of the first conduit; and means for ionizing one or more analytes contained within the liquid droplets wherein the means for mechanically perturbing the liquid sample comprises an oscillating diaphragm in fluid communication with the liquid sample within the conduit.

2. The apparatus of claim 1, wherein the conduit comprises a capillary tube.

3. The apparatus of claim 2, wherein the nebulizer gas has a flow rate in a range from about 0.1 L/min. to about 20 L/min.

4. The apparatus of claim 1, wherein the nebulizer gas has a flow rate such that a mass ratio of the nebulizer gas to the liquid sample being nebulized is less than about 50 over a liquid flow range of about 10 μL/min to about 10 mL/min; and optionally wherein the nebulizer gas has a flow rate such that the mass ratio is less than about 30 over the liquid flow range of 10 μL/min to 10 mL/min.

5. The apparatus of claim 1, wherein the outlet end of the conduit comprises a nozzle.

6. The apparatus of claim 1, wherein said means for perturbing the liquid sample comprises means for increasing the internal energy of the liquid sample; optionally wherein said means for perturbing the liquid sample comprises means for generating pressure waves within the liquid sample; and optionally wherein said pressure waves are configured to generate cavitation bubbles within the liquid sample.

7. The apparatus of claim 1, wherein the diaphragm oscillates at a frequency less than about 20 kHz; and optionally wherein the frequency is less than about 1000 Hz.

8. The apparatus of claim 6, wherein said means for perturbing the liquid sample comprises an ultrasonic transducer.

9. The apparatus of claim 1, wherein said means for perturbing the liquid sample is configured to generate cavitation bubbles within the liquid sample.

10. The apparatus of claim 1, wherein said means for perturbing the liquid sample comprises flow restrictions in said conduit and optionally wherein said means for perturbing the liquid sample comprises baffles within said conduit.

11. The apparatus of claim 1, wherein said means for perturbing the liquid sample is configured to increase a liquid/gas phase heterogeneity of the liquid sample within the conduit, wherein the liquid sample comprises a substantially homogenous liquid phase at the inlet end of the conduit.

12. The apparatus of claim 1, further comprising a heater for heating the liquid sample flowing in the conduit.

13. A method of generating ions for analysis by a mass spectrometer, comprising:

receiving a liquid sample at an inlet end of a conduit from a sample source;

transporting the liquid sample from the inlet end of the conduit to an outlet end of the conduit;

mechanically perturbing the liquid sample while being transported within the conduit and prior to being discharged in the chamber;

wherein the conduit outlet extends through a second conduit configured to supply a nebulizer gas at the outlet of the first conduit;

discharging the entire liquid sample from an outlet end of the conduit to an ion source chamber such that the discharged liquid forms a sample plume comprising a plurality of liquid droplets; and ionizing an analyte contained within the liquid droplets prior to entering a sampling orifice of a mass spectrometer in fluid communication with the ion source chamber wherein said means for perturbing the liquid sample is configured to inject gas within the liquid sample and further comprises means for mixing the liquid sample following gas injection to distribute gas bubbles within the liquid sample.

14. The method of claim 13, wherein perturbing the liquid sample comprises increasing the internal energy of the liquid sample and optionally wherein perturbing the liquid sample comprises generating pressure waves within the liquid sample in the conduit.

15. The method of claim 13, wherein perturbing the liquid sample comprises generating cavitation bubbles within the liquid sample in the conduit.

16. The method of claim 13, wherein mechanically perturbing the sample comprises increasing a liquid/gas phase heterogeneity of the liquid sample within the conduit, wherein the liquid sample comprises a substantially homogenous liquid phase at the inlet end of the conduit.

17. The method of claim 13, further comprising heating the liquid sample within the conduit.

* * * * *